US009428324B2

(12) United States Patent
Jotz et al.

(10) Patent No.: US 9,428,324 B2
(45) Date of Patent: Aug. 30, 2016

(54) PACKAGING UNIT FOR A ROLL OF MATERIAL

(71) Applicant: Schott AG, Mainz (DE)

(72) Inventors: Matthias Jotz, Alfeld (DE); Eberhard Bachmann, Eschau (DE)

(73) Assignee: Schott AG, Mainz (DE)

( * ) Notice: Subject to any disclaimer, the term of this patent is extended or adjusted under 35 U.S.C. 154(b) by 0 days.

(21) Appl. No.: 14/642,037

(22) Filed: Mar. 9, 2015

(65) Prior Publication Data

US 2015/0251845 A1 Sep. 10, 2015

(30) Foreign Application Priority Data

Mar. 10, 2014 (DE) ..... 10 2014 204 313
Jan. 30, 2015 (DE) ..... 10 2015 001 177

(51) Int. Cl.

| | |
|---|---|
| ***B65D 85/672*** | (2006.01) |
| ***B65D 25/10*** | (2006.01) |
| ***B65D 81/05*** | (2006.01) |
| ***B65D 81/107*** | (2006.01) |
| ***B65D 81/127*** | (2006.01) |

(52) U.S. Cl.

CPC ..... *B65D 85/672* (2013.01); *B65D 25/10* (2013.01); *B65D 81/051* (2013.01); *B65D 81/107* (2013.01); *B65D 81/127* (2013.01); *B65D 2519/0081* (2013.01)

(58) Field of Classification Search

CPC ..... B65D 25/10; B65D 25/22; B65D 25/26; B65D 81/05; B65D 81/051; B65D 81/07; B65D 81/113; B65D 85/04; B65D 85/48; B65D 85/672; B65D 81/107; B65D 81/127; B65D 2519/0081; B65H 18/28; B65H 75/14; B65H 75/141; B65H 75/143; B65H 75/145; B65H 75/146; B65H 75/148; B65H 2701/19

USPC ..... 206/389, 397, 407, 408; 242/160.1, 242/160.3, 160.4

See application file for complete search history.

(56) References Cited

U.S. PATENT DOCUMENTS 3,685,644 A 8/1972 Cothran et al.
3,796,305 A * 3/1974 Beason ..... B65D 85/04 206/407

(Continued)

FOREIGN PATENT DOCUMENTS

DE 10 2013 215 654 A1 2/2015
JP 3-250976 A 11/1991

(Continued)

*Primary Examiner* — Bryon Gehman
(74) *Attorney, Agent, or Firm* — Taylor IP, P.C.

(57) ABSTRACT

A packaging unit for a glass wound on a winding shaft includes a transport unit with a mounting support for the winding core which has a transport unit interior part and a transport unit exterior part. The transport unit interior part includes a floor element and side elements. The transport unit exterior part includes a floor element, side elements and a cover element. The mounting support for the winding core is always connected with or formed by two side elements of the transport unit interior part which are located opposite each other. The transport unit interior part is spaced apart from the transport unit exterior part in a floor region by spring elements, so that the transport unit interior part is arranged vibration-decoupled from the transport unit exterior part. A method of utilizing a transport unit for packaging a glass that is wound on a winding core is also disclosed.

20 Claims, 3 Drawing Sheets

(56) References Cited

U.S. PATENT DOCUMENTS

| | | | | |
|---|---|---|---|---|
| 3,998,326 | A * | 12/1976 | McKee, Jr. | B65D 85/04 206/389 |
| 8,497,006 | B2 * | 7/2013 | Tomamoto | B65D 85/672 242/160.3 |
| 2007/0131574 | A1 | 6/2007 | Aoki | |
| 2014/0284236 | A1 * | 9/2014 | Kuebart | B65D 85/672 206/408 |
| 2015/0224744 | A1 | 8/2015 | Neuhauesler et al. | |

FOREIGN PATENT DOCUMENTS

| | | | | |
|---|---|---|---|---|
| JP | 2009-173307 | A | 8/2009 | |
| JP | 2011126566 | A * | 6/2011 | B65D 85/672 |
| WO | 02/051757 | A2 | 7/2002 | |
| WO | 03/051783 | A1 | 6/2003 | |
| WO | 2005/030611 | A1 | 4/2005 | |
| WO | 2008/123124 | A1 | 10/2008 | |
| WO | 2010/038760 | A1 | 4/2010 | |

* cited by examiner

PACKAGING UNIT FOR A ROLL OF MATERIAL

BACKGROUND OF THE INVENTION

1. Field of the Invention

The current invention relates to a packaging unit for a glass wound on a winding shaft, and also to the use of said packaging unit.

2. Description of the Related Art

Thin glass is increasingly being used for diverse applications, for example in the field of consumer electronics. As cover glasses for semiconductors, organic LED-light sources, thin indicator devices or in the field or regenerative energies or energy technology such as solar cells. Examples for this are touch panels, capacitors, thin film batteries, flexible printed circuit boards, flexible OLED's, flexible photovoltaic modules or e-papers. Thin glass is coming increasingly into focus for many applications, due to its outstanding characteristics, such as resistance to chemicals, temperature changes and heat, gas tightness, high electric insulation properties, customized coefficient of expansion, pliability, high optical quality and light transparency or also high surface quality with very little roughness due to a fire polished surface. Thin glass is understood to be a glass panel, glass web or a glass film or glass substrate with thicknesses of less than approximately 1.2 mm to thicknesses of approximately 1 to 15 μm, such as 5 to 15 μm. Due to its pliability, thin glass is increasingly wound after its fabrication and stored in the form of a glass roll, or transported in roll form for packaging or further processing. Compared to storing and transporting flat material, wound glass offers the advantage of cheaper, more compact storage, transport and handing in further processing.

In order to further reduce transportation and storage costs it is advantageous to wind radii that are as tight as possible, which increases tensile stresses in the glass ribbon and thereby the risk of breakage.

With all of the outstanding characteristics, glass as a brittle material has a rather low breaking resistance since it is less resistant to tensile stresses. For breakage-free storage and for breakage-free transportation of such a glass roll, the quality and integrity of the edges are firstly of importance in order to avoid origination of a crack or breakage in the wound glass ribbon. Even damage such as tiny fissures or microscopic cracks or chipping at the edge can become the cause for large cracks or breakage in the glass ribbon. In a wound up state, the top side of the glass ribbon is subject to tensile stress, which is why integrity and freedom of the surface of the glass ribbon from scratches, grooves or other surface defects is important in order to avoid the development of a crack or break in the wound thin glass. Thirdly, manufacture related interior stresses in the glass should be minimized, or nonexistent, in order to avoid development of a crack or break in the wound glass ribbon. Since in commercial manufacturing all three factors can only be optimized to a limited extent, the vulnerability of breaks occurring in such a wound glass is further increased relative to the already existing limits of its material properties. Special precautions and conditions are therefore important for storage and transportation of such a glass roll in order to avoid damage to the glass. A glass roll of this type must be protected in particular from jolts and vibration-related stresses. Such mechanical stresses acting from the outside could lead to exceeding the breaking limit of the glass and could therefore result in the formation of cracks in the glass. If, for example, a glass roll is placed directly onto a storage surface, such as a pallet, in a position where the axis progresses approximately horizontally, then the problem exists that a stress concentration occurs in the contact region, thus easily causing fractures in the glass.

Highly sensitive goods such as thin glass on a roll are very vulnerable during transport, the primary influences being maximum acceleration peaks as well as vibrations. In transport packaging solutions where the transported good is vibration-decoupled from the packaging, resonances occur which increase the acting acceleration many times over.

For transport logistic reasons, the packaging of a glass roll should be able to be handled as simply as possible; should be able to be easily loaded and unloaded with the glass roll that is to be protected; its volume and weight to be as low as possible; and be inexpensive and be recyclable or disposable in an environmentally friendly manner.

Storage, transport and handling of sheet glass materials is crucial with thicker glasses which are not pliable enough to be wound, such as flat glasses and known glasses for flat screens. Packaging for such sheet glass materials is described, for example, in US 2007/0131574 or JP 048577/1990. Such packaging, however is not compact and is totally unsuitable for packaging of a glass roll.

Packaging of a wound material on a roll is described in WO 2008/123124. Here, a plate-shaped flange component having an attached tubular part which engages into the hollow space of a winding core is described for protection against jolts for both sides of the roll. The two parts should always be integral, formed from polyolefin-bead foam which is intended to absorb the impact energy. Furthermore, a space is provided for the protection of the edges between the upper edge of the wound material and each flange. This type of packaging is however unsuitable for a glass roll since on the one hand, the glass roll would be entirely unprotected in its surface expansion between the flanges, and on the other hand vibrational energy and impact energy would be introduced into the glass in an unacceptable manner, in spite of the provided space and the material selected for the roll support. Moreover, no secure option for storage and transportation of a multitude of glass rolls is provided.

In a further development, JP 2009-173307 describes a form of packaging for storage and transportation of a sensitive pressure measuring sheet wound on a winding core, wherein a flange which is larger in size than an outside diameter of the wound pressure measuring sheet is provided at each end of the roll core around which the measuring sheet is wound. The pressure measuring sheet is hereby arranged at a distance from the placement surface. A glass film, in contrast to a pressure measuring sheet, is a material which breaks easily. This means, that in the case of a pressure measuring sheet, it is sufficient to ensure that the microcapsules formed on the surface for pressure measurements do not burst, however in the case of wound glass it is necessary to ensure that no breaks occur on the surface of the roll or at the edges of the glass ribbon which form the lateral regions of the roll or, respectively, the thin glass. Since, in particular, it may be the case that the two lateral regions of the roll are exposed outwardly with the edges of the glass ribbon, they may easily become a starting point for breaks at the edges.

WO 2010/38760 describes a further development for a glass roll. For a glass roll wound on a winding core having lateral flanges, various arrangements for buffering with buffering material which is being introduced between the lateral regions of the glass roll and the flanges are described. It is hereby intended that contact between the edges of the glass ribbon and the flanges, which could lead to breaks, is thus avoided.

For this purpose, laterally protruding intermediate layers wound in between the glass ribbon layers are proposed which fill only part of the space and which are not in contact with the flanges or which—in another proposed embodiment—are in contact with the flanges. However, cracks or breaks may form in the glass ribbon or at the edges during winding or unwinding of the glass roll if the protruding regions of the intermediate layer interlock or catch on each other. Jolts or oscillations during transport may also lead to lateral movement of the glass ribbon layers, which likewise leads to breaks of the glass ribbon, or to edge damage. A lateral movement of the glass ribbon may occur hereby in its entirety along the axial direction of the winding core or in that the outer layers of the glass ribbon move laterally on the roll relative to the inner layers of the glass ribbon, causing the edge of the glass ribbon to then be arranged above one another in a step-like manner, in the sense of "telescoping".

In another arrangement a separate buffer material is arranged between the glass roll and flange. Lateral movement of the glass ribbon layers on the roll caused by jolts or vibrations during transport could hereby be reduced. However, in particular in the case of transport-related vibrations, a relative movement between glass ribbon edges and such buffer material will result. Even very small relative movements or stresses caused thereby at the edges of the glass ribbon can result in damage to said edges or can introduce cracks into the glass ribbon.

In order to avoid this it is proposed in another embodiment to arrange the buffer material to make contact only with the flange, but to have no contact with the lateral regions of the glass roll. However, here again, a lateral movement of the glass ribbon layers on the roll as a whole or a lateral telescoping may occur due to jolts or vibrations during transport, again causing breaks in the glass ribbon or edge damage.

WO 2010/038760 moreover describes the design of an axis, extended on both sides and protruding beyond the flanges which are supported on mounts in the form of pedestals. This is intended to prevent rotation of the glass roll independently of the flanges. Such a structure or a plurality of such structures may also be covered by a packaging crate. A disadvantage of this solution is, however, that jolts and vibration-related stresses are transferred onto or into the glass roll in an undamped state which represents a high risk for breaks or cracks in the glass. The glass roll is also not protected against vibrations, jolts and relative movement in horizontal or vertical direction, or against rotation. This type of packaging can moreover only be loaded and unloaded from two sides, which represents a significant restriction in regard to handling and logistics.

Alternatively to this packaging wherein the glass roll is oriented transversely, a packaging is described wherein the glass roll is oriented vertically. Here, a plurality of glass rolls is placed with their winding cores on vertically positioned column-type elements which are fixed to the floor of a crate body. However, wobbling of the glass rolls during transport presents a disadvantage. Even though—in order to prevent breakages of the glass ribbon thus caused—sufficient spacing between the glass rolls or the provision of a buffer material between the glass rolls is suggested, the edges on the supporting face of the glass roll are being stressed in an improper manner, not only due to the inherent pressure of the glass roll, but in particular also due to wobbling of the roll, which leads to cracks and breaks in the glass ribbon and to damaged edges. Moreover, jolts and vibration related stresses are also transferred in this case undamped to the glass roll, representing a high risk for breakages or cracks for the glass.

It is therefore the objective of the current invention to avoid the previously described disadvantages and to provide a packaging unit to accommodate glass wound on a winding core at a reasonable cost and which is easy to handle and wherein the risk of breakage or crack formation in the glass during storage or transport is reduced. The packaging unit can also permit loading and unloading from four sides.

SUMMARY OF THE INVENTION

The invention includes a packaging unit to accommodate glass which is wound on a winding core. The glass which is to be packaged with the inventive packaging unit can be wound onto a winding core in the form of a glass ribbon or glass fiber. The glass on the winding core can then be simply, safely and economically packaged, that is loaded and unloaded in the transport unit of the packaging unit. In spite of the very simple design of the transport unit of the packaging unit, the winding core with the wound glass, in other words the glass roll, is secured against movement in X-, Y- and Z-directions or against a movement relative to the packaging. X-direction is understood to be a movement in axial direction of the winding core relative to the transport unit. Y-direction is understood to be a movement along the circumference of the winding core, in other words a radial or respectively rotating movement of said winding core. Z-direction is understood to be a movement of the winding core in vertical direction relative to the transport unit. A slight rotational movement in Y-direction is even noncritical with this type of packaging.

The wound glass can be housed in the packaging to be shock-resistant and break-resistant during transport. The packaging unit serves the internal transport, handling and storage, as well as external transport, such as via truck, ship or plane. It meets the criteria of testing standards for Packaging of the American Society for Testing and Materials, the ASTM Standard D4169-09 with a greater than or equal to four times Warehouse Stacking (according to ASTM D4169-09, Schedule B). This means, the packaging units can be stacked on top of one another for storage four high and more. It also meets the criteria of the ASTM Standard D4169-09 with a greater than or equal to double Vehicle Stacking (according to ASTM D4169-09, Schedule C). This means, that two or more packaging units can be stacked on top of one another in vehicles.

The packaging unit according to the invention includes a transport unit with a mounting support for the winding core, wherein the transport unit comprises a transport unit interior part and a transport unit exterior part. The transport unit interior part includes a floor element and side elements. The transport unit exterior part includes a floor element, side elements and a cover element, and the mounting support for the winding core is connected always with two side elements of the transport unit interior part which are located opposite each other, or is formed by these side elements. The transport unit interior part is spaced apart from the transport unit exterior part in a floor region by spring elements, so that the transport unit interior part is arranged vibration-decoupled from the transport unit exterior part.

In one embodiment, the mounting support for the winding core is formed by two saddles which are connected via two side elements of the transport unit interior part which are located opposite one another, or are formed by these. The winding core, or a holding element connected with it, has an extended region on both sides relative to a glass material which can be wound onto the winding core; and the outside diameter of the winding core or of the holding element which is connected with it can, in its extended region, be placed on the saddles, following the contour of at least part of its circumference. The winding core has an extended region that can be on both sides, relative to the glass which is to be wound onto it, which can be mounted on saddles. Alternatively, a holding element can also be provided at the ends of the winding core or through the winding core, which can be placed on the saddles. Such a holding element can, for example, be a tube or a support rod which is fitted into or through the winding core and which can be placed onto the saddles in its region which is extended relative to the glass which is wound on the core. Also all other solutions for mounting a winding core known in the art are covered by the current invention. Moreover, with a holding element such as a support rod or support tube, two more winding cores with wound glass can be connected and be accommodated in a break-resistant and shock-resistant manner by the packaging unit.

In the floor region, the transport unit interior part is spaced apart from the transport unit exterior part by spring elements. At the side regions, the transport unit interior part can be separated from the transport unit exterior part by damping elements. In order to dampen the transport unit interior part in a vertical upward direction, in the direction of the cover element of the transport unit exterior part and to protect it against movement, or to space it apart from the transport unit exterior part, damping elements can be provided at locations on the top edges of the side components of the transport unit interior part, which can be held by respectively assigned counter mounts which are firmly connected with the transport unit exterior part. A damping element can be, for example, provided on the upper edge corners of the side components.

Damping elements can be provided, in one embodiment, not only between the transport unit interior part and the transport unit exterior part, but also on the side walls of the transport unit interior part. In such an embodiment, it is sufficient if only a partial surface of the transport unit interior part comprises the damping elements.

The transport unit and its interior and exterior part can be polygonal, square or rectangular.

A configuration of the spring elements can limit the acceleration factor for a glass roll packed in the packaging unit at a resonance frequency of the packaging unit with glass roll to less than 8, less than 5, less than 3, or less than 2. The acceleration factor is hereby the quotient or, in other words, the ratio of the measured acceleration of the packaging unit with glass roll at its resonance frequency to the introduced acceleration, for example during transport or testing. A predefined acceleration to determine the acceleration factor is normally 0.1 g ($g=9.80665\ m/s^2$).

Moreover, the resonance frequency can be favorably adjusted through the configuration of the spring elements. In the case of truck transportation, the relevant frequency is, for example, at 3 to 15 Hz (Hertz). The resonance frequency of the packaging unit with glass roll would advantageously be outside this range—in other words less than 3 Hz or greater than 15 Hz. During transport, resonances having different frequencies usually occur per individual packaging unit with glass roll. The spring elements must be adapted to the weight of the glass roll.

One crucial factor for the resonance frequency of the packaging unit with a glass roll is the weight of the glass roll. The weight of the glass roll can greatly differ since, due to economic consideration, many different lengths of wound glass ribbon, for example 5 m to 10,000 m, or also many different glass ribbon widths, for example 5 mm to 2,000 mm, should be suitable to be packaged in a packaging unit. Packaging is also possible of several glass rolls adjacent to one another, whereby the individual winding cores are supported or are connected with each other via a connection such as a holding element. A higher weight herein causes resonances at lower frequencies. If the resonance frequency of the packaging unit with glass roll is outside the transport related frequency range, then the acceleration factor could also be tolerable at a higher rate since a rise in the resonance range of the glass roll in the packaging unit is not caused by a transport. Packaging units which are economically interesting for packaging of a glass roll are, however, generally with at least one dominant resonance frequency within the critical frequency band, so that in the case of excessive acceleration due to a rise in the resonance frequency, the glass ribbon would experience damage and would break on the roll. The acceleration factor should be as small as possible for this reason. Therefore, the previously specified values for an acceleration factor of less than 8 are important in order to meet the requirements of ASTM Standard and to ensure secure packaging.

In the interior part of the transport unit the glass roll has no direct connection to the side parts, the floor and the cover of the transport unit exterior part, only through buffer elements in the saddle region, the spring elements in the floor region as well as the damping elements in the side region and upper stops, whereby the glass roll is securely protected and minimal jolts or vibrations can be transferred from the exterior part of the transport unit to the glass roll. The transport unit exterior part is stackable and vibrations are not transferred to the rolled up and packaged glass material, thus providing break-proof packaging.

The glass material can be a thin glass or a glass film having a thickness of less than 350 μm, less than 250 μm, less than 100 μm, or less than 50 μm and at least 1 μm, at least 5 μm, 10 μm, or at least 15 μm. Glass film thicknesses can be, for example, 15, 25, 30, 35, 50, 55, 70, 80, 100, 130, 145, 160, 190, 210 or 280 μm. However, a different glass material, such as glass fibers or a glass laminate, in particular a glass-plastic laminate may hereby also be involved. A possibility would also be glass ceramics, glass-metal-laminates, glass-glass laminates, coated glass films, processed glass, structured glass or pre-tensioned glass.

The glass film is a continuous long ribbon of a certain length, whereby the glass film in a glass roll can have a single continuous length, or several shorter lengths may be wound on a roll. Such glass films can have a width in the range of 5 to 2,000 mm, 50 to 1,000 mm, or 300 to 800 mm and a length of 5 to 10,000 m or 200 to 1,000 m. In one embodiment, several glass films may also be wound beside one another on a winding core. In another embodiment, glass films can each be wound on a separate winding core, whereby the individual winding cores are subsequently connected axially, for example via a holding element.

Such glass films are produced in the known down-drawn process or in the overflow-downdraw-fusion process (see for example WO 02/051757 A2 for the down-draw method as well as WO 03/051783 A1 for the overflow-downdraw-fusion method). The formed and drawn continuous ribbon is wound into a glass roll and sized to length.

Intermediate layers which normally consist of paper or a polymer can be wound simultaneously between the glass film layer for the protection of the glass surface or also to stabilize the wound roll.

The inventive packaging unit serves to accommodate a glass material which is wound on a winding core, wherein in one embodiment on both sides of the winding core is an extended region relative to the glass material. The winding core can have an outside diameter of 100 to 800 mm or 150 to 600 mm and may consist of any stable material such as wood, plastic, cardboard, metal or a composite material. Common winding core diameters can be 150, 200, 300, 400, 500 and 600 mm. On its surface it may also have a suitable slip-resistant and, if required, a compressible coating or a structured surface. A winding core can be round or square. The winding core can be tubular, so that it can be positioned in each Y-direction onto the saddles and can be picked up from these.

The winding core can be longer than the width of the wound glass ribbon and protrude laterally from the glass material. This lateral protrusion serves to secure the winding core in the packaging unit, so that the wound glass can be stored contact-free and shock-proofed in the packaging unit.

At least one end, or both ends of the winding core, in other words the winding core with its face sides, can be positively placed on a saddle. This means the outside diameter of the winding core in its extended region can—following the contour of a part of its circumference—be stored on a saddle. A section that is smaller than half of the circumference can be surrounded by the saddle. The contact surface of the saddle hereby follows the outside contour of the winding core. With its protruding or extended region, the winding core can also rest more selectively, that is on several individual points on the saddle, or be held by same. In another embodiment, one or both saddles are constructed in two parts, so that they can always surround the entire outside circumference of the winding core in its extended region.

According to the invention, a saddle and additional elements of the transport unit interior part which are assigned to the saddle can have a rigid design. The flexural rigidity of the saddles is assessed such that the position of the saddles relative to each other during storage or transport of a packaged glass roll do not change in such a way that secure storage of the winding cores on a saddle can no longer be assured.

In order to accommodate a certain winding core diameter, the packaging unit is equipped with the appropriate saddle measurements on the relevant side units of the transport unit interior part. The transport unit interior parts can be accordingly changed out to accommodate other winding core diameters and are securely connected and vibration-decoupled with the transport unit exterior part.

The saddles can consist of any stable material such as wood, wood composites, plastics or metal.

To secure the winding core in the packaging unit, it is pressed against the mounting support, which can be the saddle, by a holding device and fixed to same. First and foremost, this avoids movement of the winding core in the Z-direction, or in other words bouncing or, respectively, vibrating of the winding core on the saddle. A slight movement in Y-direction, in the other words a slight movement of the winding core in rotational direction, is non-critical with this packaging solution. This can, however, be avoided through suitable measures, such as slip resistance of the winding core on the saddles or specification of the fastening pressure. Mechanical fastening of the winding core with one saddle at a time can also be provided. For this purpose, a peg in the embodiment of, for example, a bolt or pin is fastened on the contact surface of the saddle for the winding core which, during placement of the winding core, engages into a bore or into a blind hole on the placement surface of the winding core. This secures the winding core against a movement in the X- and Y-directions.

The packaging unit can further comprise a fastening device, which can include a belt, strap, metal strap, metal tension strap or perforated strap, with which the winding core or a holding element which is connected with it can be secured to the mounting support. The winding core can be secured on the mounting support on both saddles with a fastening element. The fastening elements have appropriate anchoring on the transport unit interior part. Assembly elements may be a belt, strap, metal strap, metal tension strap or perforated strap, however also any other type of fastening is part of the current invention.

The winding core can alternatively also be laterally extended by a holding element or holding elements on one or both sides. The holding element or the holding elements are connected accordingly with the winding core. According to the explanations above, the lateral extensions in the embodiment of the holding elements then rest on the mounting supports, and the saddles can be connected with these.

In order to ensure storage of a glass roll in the packaging unit that is as vibration-free and break-proof as possible, a buffer element can be arranged for accommodating the winding core or a holding element connected with it on the mounting support, such as the two saddles. In the case of a packaged glass roll, the buffer element can be disposed between saddle and winding core or holding element and serves, in particular, to absorb very strong jolts, namely when the maximum deflection of the principle vibration damping is reached by the spring elements. The principle vibration damping occurs between the vibration-decoupled interior part and exterior part of the transport unit which are only connected with each other through a resilient foam material. The mounting support for accommodation of the winding core or of a holding element connected with it includes a buffer material consisting of any suitable material, such as a felt material, rubber material or a foamed polymer material, such as, for example, a polyolefin foam, or a cross-linked polyolefin foam, or also a foamed polymer consisting of polyethylene or polyurethane. The foams can be closed-cell. The transport unit interior part can be a sturdy frame consisting of metal, plastic, wood or a wood composite material, such as a laminated wood. The frame absorbs the lateral forces, for example, during a transport-related tipping of the transport unit and is designed with sufficient flexural rigidity. The floor of the transport unit can be a solid plate. However, in order to reduce cost and weight, the floor can consist of individual elements, such as strips, whereby they cover the spring elements partially or completely.

The lateral part of the frame of the transport unit interior part is formed by side elements, such as braces. In one embodiment, two side elements are formed by braces and two by side walls that support or form the saddles. The mounting supports can be connected as two separate elements with two side elements which are located opposite one another or they can also be embodied by recesses, cut-out sections or shaping in two side elements or side walls facing each other. Alternatively, four side walls may also be provided. Alternatively, braces may also be provided as side elements on all sides, whereby on two braces that are facing each other, support mounts for accommodating or fastening the winding core or a holding element connected with it are arranged. In each of the designs, the side element, together with the floor, provide sufficient rigidity to the transport unit interior part.

The transport unit exterior part can be a sturdy frame consisting of metal, plastic, wood or a wood composite material, such as a laminated wood with an appropriate floor, side parts and an appropriate cover element that is hinged or can be placed on it. The transport unit exterior part absorbs the lateral forces, for example, during a transport-related tipping of the transport unit and is designed with sufficient flexural rigidity. It serves to protect the interior part of the transport unit with a glass roll that is to be packaged within same.

In one embodiment, the cover element is designed so that it comprises a part of the overall height of the four sides of the transport unit exterior part, so that—for the purpose of easier loading and unloading—the packaged glass roll protrudes beyond the part of the side elements that are connected with the floor when the lid is opened or removed.

An embodiment of the transport unit which is a part of the packaging unit comprises a transport unit interior part and a transport unit exterior part, whereby the transport unit interior part includes a floor element and four side elements; and the transport unit exterior part includes a floor element, four side elements and one cover element and whereby the transport unit interior part is spaced apart from the transport exterior part in the floor region by spring elements, in the side region and in the direction of the cover element by damping elements, so that the transport unit interior part is arranged vibration-decoupled from the transport unit exterior region.

In addition to the damping elements which space apart the side regions from the transport unit exterior part and the transport unit interior part, damping elements facing into the interior of the transport unit interior part can also be arranged on the side walls of the transport unit interior part. The damping elements in the regions of the side walls of transport unit exterior part and/or transport unit interior part serve to protect the glass roll from damage if the glass roll comes into contact with the side walls. Moreover, it is not necessary for the damping elements which are arranged between transport unit interior part and transport unit exterior part to cover the entire surface. Damping elements that cover only a partial surface of the side walls are possible.

Components, in particular wood components, may be provided in the interior of the transport unit interior part which serve to support the rigidity of the transport unit interior part.

Damping elements for damping an impact from the front and back can moreover be provided on the outside of the transport unit interior part.

With a specified acceleration, the configuration of the spring elements is essential for vibration-decoupling in conjunction with a reduced increase of the acceleration at resonance frequency of the packaging unit. Spring elements in the embodiment of two-dimensional resilient foam materials were found which, independent from the weight of the glass roll, at a certain area expansion, a certain volume weight and certain compression hardness strongly limit an increase of the acceleration at resonance frequency and thereby ensure secure packaging of the glass roll.

The configuration of the spring elements on the underside of the transport unit between the transport unit interior part and exterior part has the greatest influence upon the vibration-decoupling, in conjunction with a reduced and lower acceleration factor at resonance frequency of the packaging unit with glass roll.

The spring elements can be formed from a foam material, such as a polyurethane foam material. The foam material possesses resilient characteristics, in other words, it has complete, almost complete or very good recovery properties after compression, in particular after compression at a prevailing preload. It furthermore can possess dynamic properties, in other words, it builds up a resistance to the weight of the transport unit interior part with the packaged glass roll. Such foam materials can be polyurethane foam materials or polyurethane flexible foam materials on polyether basis.

The spring elements can be planar and have a surface area of 50 to 10,000 $cm^2$ (square centimeters), 900 to 6,000 $cm^2$, 900 to 4,000 $cm^2$, or 1,500 to 3,000 $cm^2$ and a thickness of 1 to 15 cm, 1 to 8 cm, or 3 to 5 cm.

The foam material can have a volume weight (according to DIN 53420, ISO 845) of 10 to 120 $kg/m^3$ (kilogram per cubic meter), 15 to 80 $kg/m^3$, or 20 to 60 $kg/m^3$ and a compression hardness at 40% (according to DIN 53577, ISO 3386) of 2 to 12 kPa (kilopascal), 3 to 10 kPa, or 4 to 8 kPa, so that at a weight of one of the glass rolls packaged in the packaging unit in the range of 10 to 260 kg the resonance frequency of the packaging unit with the glass roll packaged in it is less than 30 Hz, less than or equal to 20 Hz, less than 15 Hz, or less than 3 Hz. And the acceleration factor for a glass roll packaged in the packaging unit, at a resonance frequency of the packaging unit with the glass roll can be less than 8, less than 5, less than 3, or less than 2. Depending on the specific embodiment, there are always several resonance frequencies. The data refers always to the primary resonance frequency. The weight of the packaging unit is hereby normally in the range of 30 to 40 kg.

The resonance frequency of the packaging unit with the glass roll packaged in it can be greater than 16 Hz, since the greatest accelerations occur therein. This is so that the natural frequencies, in other words the primary frequencies of the packaging, do not coincide with the resonance frequencies of the transport which are normally between 3 and 16 Hz according to the standard measuring methods (ASTM).

The acceleration factor for a glass roll packaged in the packaging unit, at a resonance frequency of the packaging unit with glass roll—with the aforementioned materials and dimensions for the spring elements—meets the ratio $$19.2 - 6 \times \frac{G - 100}{65}$$

whereby the weight of a packaging unit with glass roll is in the range of 10 to 165 kg. The aforementioned formulas are based on the following marginal values:

The surface area of the damping elements is in the range of 1000-2400 $cm^2$, the volume weight (according to DIN 53420) is between 40 and 75 $kg/m^3$ and the compression hardness according to ISO 3861 at 40% impression depth is between 4.0 and 9.5 kPas. Inventive solutions deviating from the above formula may also be found within the scope of the disclosure for other materials and dimensions for the spring element.

The transport unit interior part can be separated from the transport unit exterior part by damping elements at the side regions which are formed by the side elements, in other words, damping elements can be provided for vibration decoupling in the lateral regions between the transport unit interior part and exterior part.

In order to limit and secure the transport unit interior part in the upward direction and in the direction of the cover element of the transport unit exterior part, the transport unit interior part can be vibration-decoupled from the transport unit exterior part by damping elements. These upper damping elements can rest on the edges of the side elements or the frame of the transport unit interior part. These damping elements can be held upward by mounts which are connected firmly with the transport unit exterior part.

The damping elements can be two-dimensional in their design and formed by a foam material, such as polyethylene foam material. The volume weight (according to DIN 53420, ISO 845) can be in the range of 10 to 120 $kg/m^3$ (kilogram per cubic meter) or 20 to 80 $kg/m^3$.

In one embodiment, the damping elements in the lateral regions of the transport unit are designed as vertically arranged strips. In another embodiment, they are designed such that on at least one damping element, or on all damping elements, their surface making contact with the transport unit exterior part is larger than their surface making contact with the transport unit interior part. This means that they are conically chamfered on one or more edges. During pressure upon the damping element, in particular during contact with the transport unit interior part, its surface area can therefore enlarge. The greater the ratio of the surface making contact with the transport unit exterior part relative to the surface making contact with the transport unit interior part, in other words, the stronger the chamfering is, the softer the damping element reacts to pressure, the greater is its surface change and thereby its damping behavior during pressure. The smaller the ratio of the surface making contact with the transport unit exterior part relative to the surface making contact with the transport unit interior part, in other words, the lighter the chamfering is, the harder the damping element reacts to pressure, the lesser is its surface change during pressure. Through appropriate design of the chamfering, a standby volume can be created for instances of strong shocks, for example extreme falls or lateral impact, thus further supporting the break-proof packaging of a glass roll in the packaging unit.

The damping elements can be arranged in the two axial directions relative to the winding core on the side elements of the transport unit exterior part and dimensioned so that they protect the winding core on its face ends from movement or vibration in the axial direction, and to keep the transport unit interior part in these directions at a dampened distance from the transport unit exterior part.

The additional provision of damping elements on the side walls of the transport unit interior part has the advantage that movements in the x-direction, in other words in the axial direction of the winding core relative to the transport unit, do not lead to damage of the glass roll. Without such damping elements, movement of the glass roll in the x-direction would certainly have to be avoided in order to protect the glass roll from damage. This can be accomplished, for example, in that the glass roll is braced in the saddle so that movement is not possible either in the x-direction or z-direction. Such bracing is costly and generally very heavy.

Such an inventive packaging element on the one hand facilitates internal handling. The inventively packaged glass roll can hereby be picked up with a handling device, for example a lifting tool from two sides transversely to the axial direction, and transported.

With the use of a tube-shaped winding core, an inventively packaged glass roll can also be picked up from two sides in the axial direction with a handling device, for example a fork lift or lifting tool, thereby facilitating versatile loading or unloading from all sides or respectively four sides which offers considerable logistic advantages.

The packaging unit can include moreover a wooden, metal or plastic transport rack, such as a transportation pallet. In one embodiment, this transport rack forms a part of the transport unit exterior part on the outside of its floor, or is connected with same.

The cover elements of the transport unit exterior part on their outside surface and the transport rack can include interlocking elements that make secure and slip-resistant stacking of the packaging unit as well as container suitable transportation possible. Such elements are known in the art.

In its closed condition, the transport unit can form a closed space which provides secure packaging for the glass roll that is to be packaged, even for a stable long distant transport or for extended storage with protection from dust and dirt and protection from outside influences such as dirt, moisture, sun radiation or falling objects. The transport rack can be a transport pallet such as a Europallet 800×1200 mm or 845×1245 mm and can be equipped with 3 runners for handling in a high rack or automated transport. The packaging unit can have the dimensions of standardized packaging, such as the aforementioned pallet dimensions. The dimensions can be a length×width×height of 1290×770×1290 mm or 1358×830×850 mm or 958×830×834 mm.

An additional embodiment may provide that the transport unit is designed so that it can be closed to be gas tight and that the interior can be filled with a clean gas. A dust- and dirt-free clean room can thereby be provided inside the transport unit which meets all the conditions demanded by the protection or cleanliness requirements for the glass. This is important in particular in the case of coated thin glass, if the coating is sensitive to substances which can act through environmental influences or also for glass substrates for displays such a liquid crystal displays or organic LED displays where clean glass without adhesion of dirt or dust is required due to their intended use. Preferred filling gasses—depending on specific requirement—are all inert gasses, for example argon, nitrogen or carbon dioxide. The relative air moisture is preferably adjusted in a range of 5-30%. Depending on requirement, an excess pressure can be produced and maintained in the interior space of the packaging unit in order to prevent penetration of ambient air.

The invention also covers the use of the described transport unit, whereby the transport unit features a mounting support for a winding core, a transport unit interior part and a transport unit exterior part; whereby the transport unit interior part includes a floor element and side elements; whereby the transport unit exterior part includes a floor element, side elements and a cover element; whereby the mounting support for a winding core is always connected with two side elements of the transport unit interior part which are located opposite one another or formed by same and whereby the transport unit interior part is spaced apart from the transport unit exterior part in the floor region by spring elements, so that the transport unit interior part is arranged vibration-decoupled from the transport unit exterior part in order to accommodate a glass material, such as a glass ribbon which is wound on a winding core.

The invention also covers the use of a described transport unit, whereby all previously described characteristics of the transport unit can also be the characteristics of the transport unit here.

The packaging unit, which substantially includes the transport unit, is suitable for vibration-reduced storage and vibration-reduced transport of glass, such as thin glass that is wound on a winding core. The installation of the transport unit interior part inside the transport unit exterior part acts as a vibration or oscillation damper in all three spatial directions or, respectively, in all six possible directions of movement derived therefrom. The spring- and damping elements but also the buffer elements reduce or absorb the transfer of vibrations and jolts from the outside to the inside to the glass roll completely or partially during handling, storage or transport of the packaging unit in such a way that the input of jolts and vibration related stresses upon or into the glass roll is effectively reduced to a level which allows safe transportation or safe storage of a glass roll. Through the configuration of the spring elements, the acceleration factor at a resonance frequency of the transport unit or, respectively, the packaging unit with a glass roll packaged therein can be limited and reduced.

During transport of a glass roll, there are four different forces which act upon the packaging unit. The force of weight $F_G$ presses from the mass directly downward onto the container. It is comprised of mass m of the packaging unit with the packaged glass roll and the gravitational acceleration g: $F_G = m \times g$. An additional occurring force is the force of inertia F. During acceleration of the transportation means, it acts against the direction of travel, and during braking acts with the direction of travel—in other words, it acts against the change. The force of inertia depends on mass m and on acceleration or respectively deceleration a of the packaging unit with the glass roll packaged therein: F=m×a. The third acting force is the centrifugal force $F_Z$. It is a form of the force of inertia and occurs when traveling around bends if the packaging unit maintains the previous direction or motion. The centrifugal force depends thereby on mass m of the packaging unit with glass roll packaged therein, the speed v of the means of transportation and on the curve radius r: $F_Z=m\times v^Z/r$. The final acting force is the frictional force FR. In dependency with the base support, it slows down the movements and displacements of the packaging unit in the transport container, for example of a transport container in a container or truck. The frictional force is comprised of the force of weight $F_G$ and the friction coefficient μ that is dependent on the base support: FR−FG×μ. In the preceding section, only the forces acting upon the glass roll from the outside were described.

During road transportation with a truck, the most common stresses are acceleration, braking and vibration during driving. Here, accelerations of 1.5 times the force of weight, in other words 1.5 g can act. During transportation via ship, stresses based on acceleration and braking do not play an important role. However, vibrations during the journey act upon the packaging unit. In heavy seas, the ship can tilt as much as 30° relative to the longitudinal axis. This causes accelerations to 0.8 g. During immersion of the ship, stresses of up to 2 g may act in the front and rear section of the ship. The stresses during rail transport are similar to those for truck-transport. Here, stresses on the packaging unit also occur during braking and acceleration of the train. The greatest loads occur during shunting of the individual carriages. If the individual freight cars are decoupled on a hill, the so-called hump, and are directed by their own gravity to certain shunting rails, accelerations of up to 4 g occur. The greatest stresses occur with air transportation in comparison to the other means of transportation. The most forces occur during take-off and landing of the plane. Great stresses occur also during turbulences.

The vibration frequencies that act upon a packaging unit during transport related vibration loads are around 1 to 200 Hz for truck-, ship- and rail-transportation and 2 to 300 Hz for air transportation. If the transport related vibration frequency is congruent with the resonance frequency, or respectively, self-resonance frequency of the packaging unit with a therein packaged glass roll as the vibration system, then an increase of the transport related acceleration occurs for the glass roll. According to the invention, this increase can be limited or reduced. The damping or, respectively, resiliency provided by the foam elements is such that the acceleration factor at the primary resonance frequency or a secondary resonance frequency of the vibration system can be less than 8, less than 5, less than 3, or less than 2 over a wide weight range of the vibration system (40 kg to 300 kg).

The stresses which are withstood by an inventive packaging unit and its use in a packaging system that is stable in long distance transportation is described in ASTM D4169-09 "Standard Practice for Performance Testing of Shipping Containers and Systems". The inventive packaging unit meets the requirements of the testing methods of this standard. Under consideration of all of these acting forces, the inventive packaging unit meets the requirements in regard to safety for a glass roll packaged therein, for transportation without damage to the glass roll or to the glass of the glass roll.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
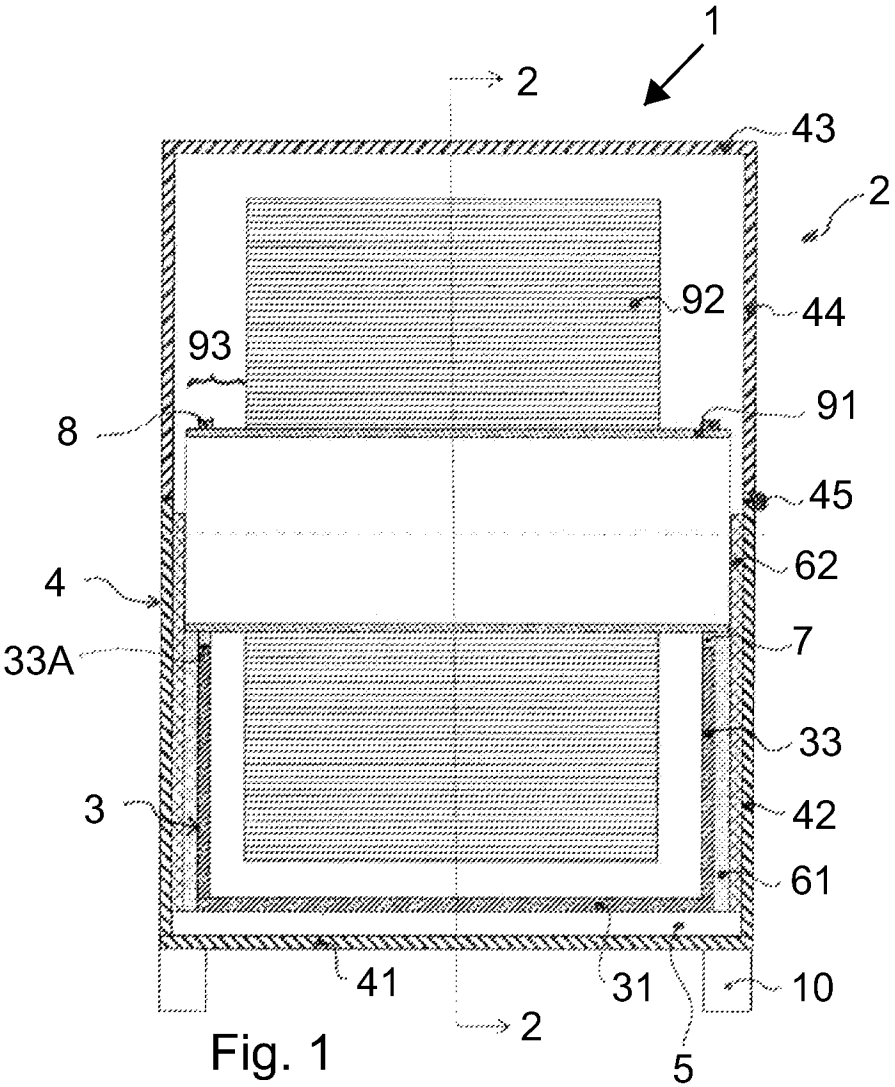
FIG. 1 is a cross-sectional view of an embodiment of a packaging unit according to the present invention taken along line 1-1 in FIG. 2.
Figure 2:
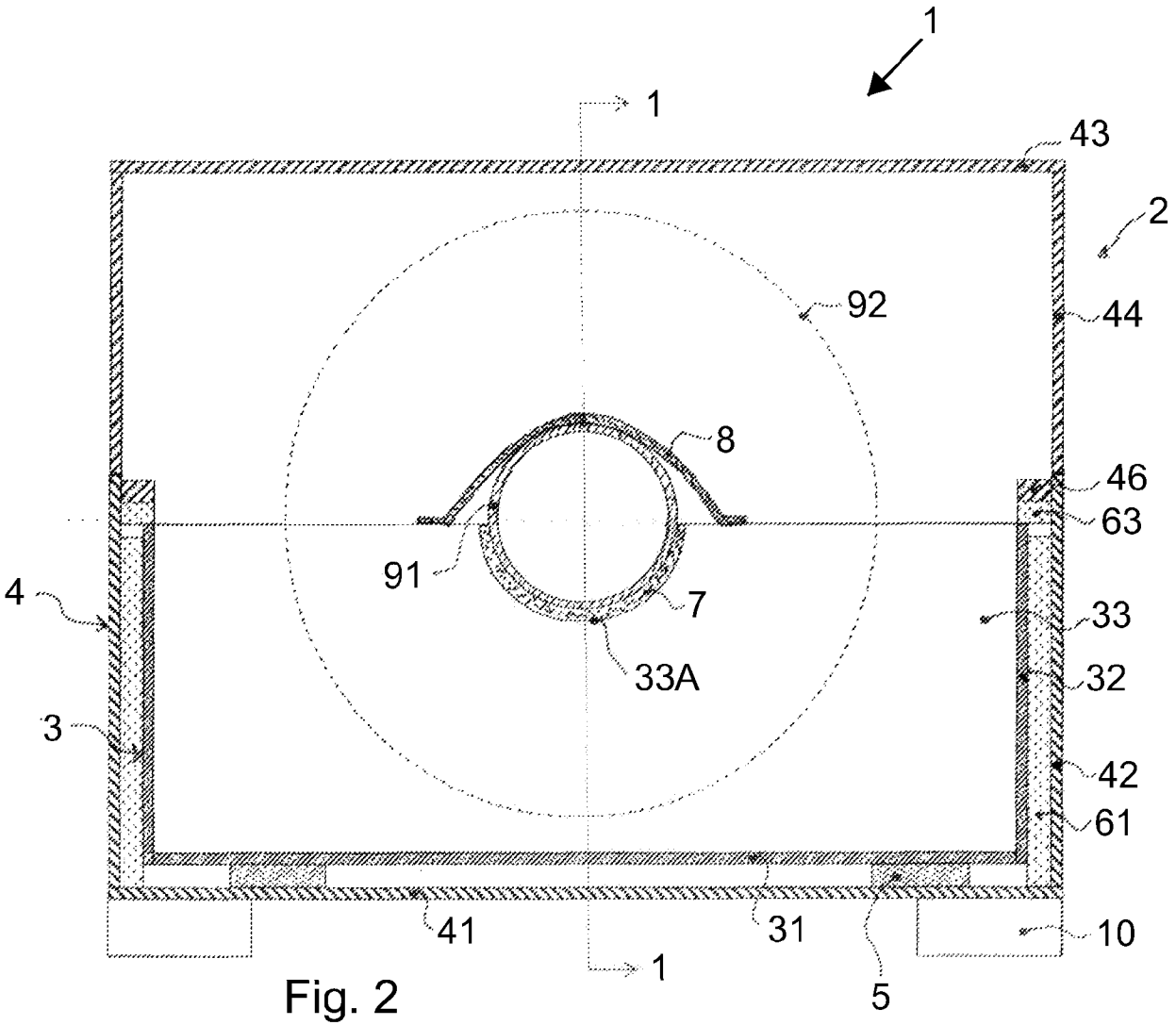
FIG. 2 is another cross-sectional view of the packaging unit shown in FIG. 1 taken along line 2-2.

Referring now to the drawings, FIG. 1 and FIG. 2 illustrate an embodiment of a packaging unit 1 with a glass roll packaged therein, with FIG. 1 showing the packaging unit 1 in a longitudinal section along line 1-1 (shown in FIG. 2) and FIG. 2 showing this packaging unit 1 in a cross section taken along line 2-2 (shown in FIG. 1). The glass roll consists of a winding core 91 and a glass material 92 wound on the winding core 91 in the form of, for example, a 1000 m long glass ribbon having a width of 600 mm and a thickness of 70 μm. The weight of the packaging unit with the therein packaged glass roll is, for example, 136 kg.

Packaging unit 1 includes a transport unit 2, a transport rack 10 and a fastening device 8. Transport rack 10 is connected directly with transport unit 2 and is formed by spacers as are common for standard pallets. Fastening device 8 is a perforated strap which firmly connects winding core 91 in its extended region 93, which laterally protrudes from the glass that is wound on it, with saddle 33 and secures it against a movement in the Z-direction.

Transport unit 2 includes a transport unit interior part 3 and a transport unit exterior part 4 which are spaced apart vibration-decoupled by spring elements 5 and damping elements 61, 62 and 63. Transport unit interior part 3 includes a floor element 31, two side elements 32, which are in the embodiment of a frame with braces, and two side elements 33, which at the same time form saddles 33A in the embodiment of half-round cut-outs. The shape of saddles 33A is adapted to the outside contour of extended winding core region 93 which it surrounds to almost half of its circumference on both sides. A buffer material 7 comprising a felt material can be arranged between saddle 33A and winding core 91. In the event of very strong jolts, where the deflection of spring elements 5 is exceeded, buffer elements 7 provide additional protection against a transfer of the impact energy onto the glass roll. Floor element 31 is arranged from individual braces in the form of strips in a frame. Spring elements 5 are hereby covered over their entire surface by respective strips. Alternatively, the floor element is a solid floor plate. Overall, transport unit interior part 3 is designed to have flexural rigidity and be distortion resistant, even for stresses caused by tipping. According reinforcements are provided in the corners.

In this example of an embodiment, transport unit exterior part 4 has a length×width×height equal to 1400×830×750 mm and includes a floor element 41, four side elements 42 and a cover element 43. Upper parts 44 of the four side elements 42 belong to cover element 43. Cover element 43 can be tipped down through hinge 45 from the lower part of transport unit exterior part 4 which is connected with floor element 41. With tipped down cover element 43, the interior space of winding core 91 or respectively the glass roll is accessible for unloading the glass roll with a handling tool. Counter mounts 46 are connected below cover element 43 with side elements 42. These counter mounts support damping elements 63 which space transport unit interior part 3 in upward direction apart from transport unit exterior part 4 and limit and dampen an upward movement in the Z-direction. Transport unit exterior part 4 can be resistant to bending and distortion, even for stresses caused by tipping. According reinforcements are provided in the corners.

Damping elements 61, 62 and 63, in the examples 1 to 4 described below, comprise a polyethylene foam as offered, for example, under the trade name Ethafoam® by Sealed Air Corporation in New Jersey, USA. The volume weight was 60 kg/m$^3$. Compression hardness according to DIN 53577 was at a compression of 10% 0.087 N/mm$^2$, at a compression of 25% 0.097 N/mm$^2$ and at a compression of 50% 0.17 N/mm$^2$. Damping elements 62, which distance the face ends of winding core 91 from side elements 42 of transport unit exterior part 4 and which limit and dampen the glass roll from an axial movement in the X-direction, had dimensions of thickness×width×height equal to 20×150×600 mm. Damping elements 61, which distance side elements 32 of transport unit interior part 3 from side elements 42 of transport unit exterior part 4, were conically chamfered. In total there were two damping elements 61 on each of the four sides with the dimensions of thickness×width×height equal to 50×25×550 mm. The contact surface on side elements 42 of transport unit exterior part 4 was 137.5 cm$^2$, the contact surface on side elements 32 of transport unit interior part 3 was 82.5 cm$^2$. Damping elements 63 were always arranged on the upper edges of side elements 32, 33 of transport unit interior part 3 in the corner regions.

Figure 3:
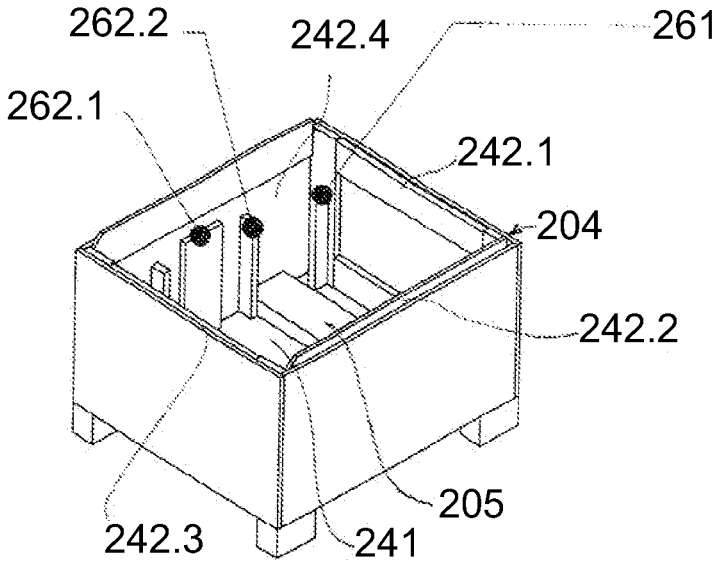
FIG. 3 is a perspective view of an embodiment of a transport unit exterior part according to the present invention.
Figure 4:
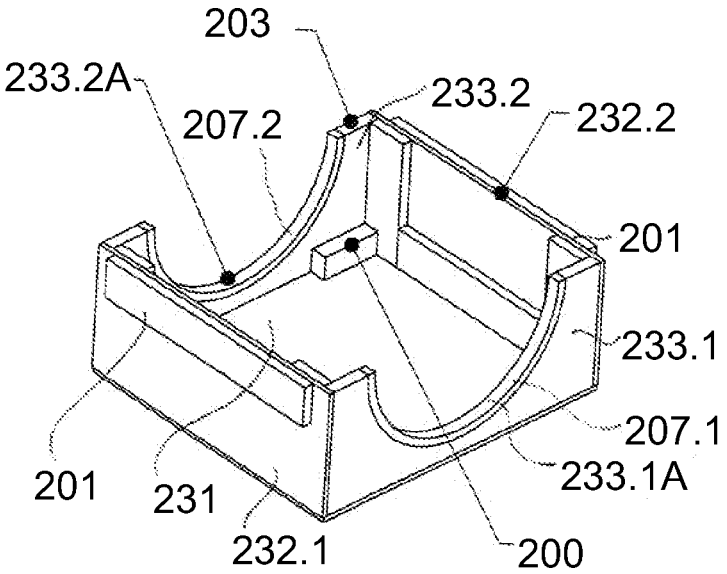
FIG. 4 is a perspective view of an embodiment of a transport unit interior part according to the present invention.

FIGS. 3 and 4 are 3-dimensional views of another embodiment of a packaging unit illustrated in FIGS. 1 and 2, with transport unit exterior part (FIG. 3) as well as transport unit interior part (FIG. 4), whereby the cover part is not shown.

Same components as are illustrated in FIG. 1 and FIG. 2 are identified by reference numbers increased by 200. FIG. 3 shows another embodiment of a transport unit exterior part 204. Transport unit exterior part 204 includes four side elements which are identified with 242.1, 242.2, 242.3 and 242.4. Each side element 242.1, 242.2, 242.3 and 242.4 is an individual component. If individual components 242.1, 242.2, 242.3 and 242.4 are connected with a floor element 241, then transport unit exterior part 204 is the result. By designing the side elements as a single part, single manageability as well as a low weight is achieved. End facing side parts 242.1, 242.3 are frame components. The end facing damping elements are designed as vertically arranged strips 261. All or some of them can be conically chamfered on one or more edges. Thanks to the conical chamfering, the impact behavior of the damping element can be adjusted in its resiliency. In other words, the resiliency becomes smaller, the smaller the inward facing damping surface is relative to the outward facing damping surface, or the larger the chamfering is. Damping elements 262.1, 262.2 are arranged on side walls 242.2, 242.4 which space apart the face sides of the winding core from side walls 242.2, 242.4. One of spring elements 205 which is arranged on floor element 241 can also be seen in the illustrated embodiment.

FIG. 4 illustrates another embodiment of a transport unit interior part 203. The transport interior part includes a floor element 231, as well as four side elements 232.1, 232.2, 233.1, 233.2. Each side element 232.1, 232.2, 233.1, 233.2 is an individual component. If individual components 232.1, 232.2, 233.1, 233.2 are connected with a floor element 231, then transport unit interior part 203 is the result. The two side elements 233.1, 233.2 form saddles 233.1A, 233.2A for the winding core region and are in the shape of half-round cut-outs. The cut-outs are moreover provided with buffer element 207.1, 207.2 which provides additional protection from a transfer of the impact energy onto the glass roll. On side walls 233.1A, 233.2A components, such as wood components 200 facing toward the inside of the transport unit interior part 203, can be provided which serve to support the rigidity of the transport unit interior part. Components 200 can be in the embodiment of blocks. In addition to wooden blocks, blocks comprising other materials, for example plastic, are also conceivable.

Moreover, in an additional embodiment, damping elements 201 are arranged on the outside of face sides 232.1, 232.2 which, when inserting transport unit interior part 203 face into transport unit exterior part 204. These damping elements serve to dampen an impact from the front and back.

Damping elements 261, 262.1, 262.2 and 200 in examples 1 to 4 described below comprise a polyethylene foam material such as offered, for example, under the trade name Ethafoam® by Sealed Air Corporation in New Jersey, USA. The volume weight was 60 kg/m$^3$. Compression hardness according to DIN 53577 was at a compression of 10% 0.087 N/mm$^2$, at a compression of 25% 0.097 N/mm$^2$ and at a compression of 50% 0.17 N/mm$^2$. Damping elements 262.1, 262.2, which distance the face ends of the winding core from side elements 242.2, 242.4 of transport unit exterior part 204 and which limit and dampen the glass roll from an axial movement in the x-direction, had dimensions of 20×150×500 mm (thickness×width×height) for damping element 261.1 which in this example is not chamfered, in other words is not conical in design. An additional block-shaped damping element with measurements of 15×150×500 mm may be installed, for example, glued onto the block-shaped damping element.

Damping element 261.2 may be a chamfered, conically tapering damping element that measures 50×25×450 mm at the widest point. The width may, for example, reduce from 25 mm to 10 mm. Damping elements 261 which space apart side elements 232 of transport interior part 202 from side elements 242 of transport unit exterior part 204 can be conically chamfered.

The spring elements were varied and are described below in examples 1 to 4.

Springs were provided in a first example. The acceleration factor was, however, greater than 10. In a trial arrangement, an acceleration of 0.1 g was specified. The resulting acceleration at resonance frequency was 1.0 g or higher. Transport unit interior part 3 built up resonance to some extent. This type of design does not meet the required properties for secure packaging in a packaging unit that reduces the risk of breakage or cracking for the glass during transport.

In a second example, a composite foam material comprising a laminated closed-cell polyethylene foam having a volume weight according to ISO 845 of 28 kg/m$^3$ was arranged as the spring element. Compression hardness according to ISO 3386/1 during a 1$^{st}$ compression of 25% was 47 kPa, during a 1$^{st}$ compression of 50% 114 kPa and during a 1$^{st}$ compression of 70% 267 kPa and during a 4$^{th}$ compression of 25% 28 kPa, during a 4$^{th}$ compression of 50% 89 kPa and during a 4$^{th}$ compression of 70% 228 kPa. However, these spring elements did not possess 100% spring-back or recovery after compression. Foam material of this type is offered, for example, under the trade name PolyLAM® by Pregis Corporation, Deerfield, Ill., USA. Two foam panels were arranged as spring elements 5 and were glued to floor element 41, whereby one foam surface was in contact with floor element 31 over an area of 2054 $cm^2$. In one exemplary trial, individual frequency accelerations of 0.1 g in a frequency band of 2 to 200 Hz were specified and the resonance frequencies determined or searched. At a resonance frequency of 21 Hz the acceleration factor was, for example, 4.

In a third example, polyurethane foam on a polyethylene base was arranged as the spring elements, having a volume weight according to ISO 845 of 58 $kg/m^3$. Compression hardness at 40% according to ISO 3386/1 was 7.0 kPa. These spring elements had 100% spring-back or recovery after compression. Foam material of this type is offered, for example, under the trade name ContiPur® 6070 by ContiTech Formposter GmbH, Lohne, Germany. Four foam panels were arranged as spring elements 5 and were glued to floor element 41, whereby one foam surface was in contact with floor element 31 over an area of 1077 $cm^2$. In one trial, a frequency band of 2 to 200 Hz and an acceleration of 0.1 g were specified. With a resonance frequency of 16 Hz the acceleration factor was 2.0. The properties required for secure packaging in a packaging unit, which reduces the risk to the glass of breakage and cracking during transport, can herewith be reliably provided according to the invention.

With the above specified materials and dimensions, the resonance frequency for a glass roll packaged in this manner in the packaging unit fulfills the ratio $$3.5 - 0.6 \times \frac{G - 100}{65} + 1.2 \times \frac{FS - 1565.5}{488.5}$$

whereby G is the weight of the packaging unit with glass roll and FS is the foam surface which is in contact with floor element 31. The above formula is based on the following marginal values:

The surface area of the damping elements is in the range of 1000-2400 $cm^2$, the volume weight (according to DIN 53420) is between 40 and 75 $kg/m^3$ and the compression hardness according to ISO3861 at 40% compression depth is between 4.0 and 9.5 kPa.

The previously specified formula is merely an example. Other materials and dimensions are also covered by the current invention.

In a fourth example, polyurethane soft foam on polyethylene base was arranged as the spring elements, having a volume weight according to ISO 845 of 38.5 $kg/m^3$. Compression hardness at 40% according to ISO 3386/1 was 5.0 kPa. These spring elements also had 100% spring-back or recovery after compression. Foam material of this type is offered, for example, under the trade name ContiPur® 4050 by ContiTech Formposter GmbH, Lohne, Germany. Two foam panels were arranged as spring elements 5 and were glued to floor element 41, whereby one foam surface was in contact with floor element 31 over an area of 2054 $cm^2$. In one trial, a frequency band of 2 to 200 Hz and an acceleration of 0.1 g were specified. With a resonance frequency of 15 Hz, the acceleration factor was 3.9.

With a foam that is too hard, the range of characteristic that are advantageous for this application begins only with very small foam surfaces. The foam surfaces must, however, not be too small because of the risk of shearing effects, the risk of slippage or detachment of the glued connection and should remain securely attached in the packaging. Larger surfaces moreover offer a greater security margin during impact stresses and long-term compression.

A glass roll packaged in a packaging unit according to examples 3 and 4 has been tested according to the testing standards for packaging of the American Society for Testing and Materials—ASTM Standard D4169-09. The following tests were conducted:

Mechanical handling (Schedule A/sec. 10.3.1 and 10.3.2) with Fork Lift Truck Handling (Assurance Level 2, Drop height pallet weight <226.8 kg; 229 mm/>226.8 kg; 152 mm) and Truck Handling (Assurance Level 2, shock acceleration 1.22 m/s)

Warehouse Stacking (Schedule B/Sec. 11.3, Assurance Level 2, L=M×((H−h)/h)×F (dwell time 3 sec. on calculated load, F is reduced according to ASTM by 30% due to full load unit in test)) [In this case: L=load; M=test object weight; J=9.8 N/kg; H=maximum stack height in storage (customer-specific); h=height of test object; F=4.5 (less 30% due to pallet test)]

Vehicle Stacking (Schedule C/Sec. 11.4, Assurance Level 2, L=Mf×J×((1×w×h)/K)×((H−h/h)×F (dwell time 3 sec. on calculated load, F is reduced according to ASTM by 30% due to full load unit in test)) [In this case: L—load; Mf=160 $kg/m^3$, J=9.8 N/Kg; I=length of test object; w=width of test object, h=height of test object; K=1 $m^3/m^3$; H=2.7 m (Container dimension); F=7 (less 30% due to pallet test)]

Vehicle Vibration I-1 and I-3 (Schedule E), Truck Spectrum (Assurance Level 1, Overall gr. Level: 0.73/testing time 30 minutes in transport position)

Vehicle Vibration I-2 (Schedule E), Air Spectrum (Assurance Level 2, Overall grins Level: 1.05/120 minutes in transport position)

Overall $g_{rms}$ Level refers herein to the effective value of the acceleration of a random vibration and is defined from the square root of surface below the curve of the acceleration spectral density (ASD).

The inventive packaging of the previously discussed examples 3 and 4 are in accordance with the guide lines of ASTM Standard D4169-09.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

1 Packaging unit
2 Transport unit
3 Transport unit interior part
31 Transport unit interior part floor element
32 Transport unit interior part side element
33 Transport unit interior part side element with saddle
33A Saddle
4 Transport unit exterior part
41 Transport unit exterior part floor element
42 Transport unit exterior part side element
43 Transport unit exterior part cover element
44 Transport unit exterior part side element as part of the cover element
45 Transport unit exterior part hinge
46 Transport unit exterior part counter mount for damping element

5 Spring element
61 Damping element side region
62 Damping element face side winding core
63 Damping element top edge transport unit interior part
7 Buffer element
8 Fastening device
91 Winding core
92 Wound glass material
93 Extended region of winding core
10 Transport rack
200 Component, in particular wooden component
201 Damping elements
203 Transport unit interior part
204 Transport unit exterior part
205 Spring element
207.1 Buffer element
207.2 Buffer element
231 Floor element
232.1, 232.2 Side element
233.1, 233.2
233.1A Saddle
233.2A
241 Floor elements.
242, 242.1
242.2 Side elements
242.3, 242.4
261 Damping element
262.1, 262.2 Damping element

What is claimed is:

1. A packaging unit for a glass wound on a winding shaft, comprising:

a transport unit with a mounting support for a winding core, said transport unit including:

a transport unit interior part including a floor element and a plurality of side elements, said mounting support for the winding core being one of always connected with two side elements of the transport unit interior part which are located opposite each other and formed by two side elements of the transport unit interior part which are located opposite each other; and a transport unit exterior part including a floor element, a plurality of side elements and a cover element, said transport unit exterior part being spaced apart from said transport unit interior part in a floor region by a plurality of spring elements residing between said transport unit interior part and said transport unit exterior part so that said transport unit interior part is arranged vibration-decoupled from said transport unit exterior part.

2. The packaging unit according to claim 1, wherein at least a part of said plurality of side elements of said transport unit interior part include at least one of damping elements and components on at least a partial surface of at least one side element to facilitate rigidity of said transport unit.

3. The packaging unit according to claim 2, wherein at least one of said plurality of spring elements and said damping elements is formed from a foam material.

4. The packaging unit according to claim 3, wherein said foam material is a polyurethane foam material.

5. The packaging unit according to claim 2, wherein at least one of said plurality of spring elements and said damping elements is planar and has a surface area of 50 to 10,000 $cm^2$ and a thickness of 1 to 15 cm.

6. The packaging unit according to claim 5, wherein at least one of said plurality of spring elements and said damping elements has a surface area of 900 to 6,000 $cm^2$ and a thickness of 1 to 8 cm.

7. The packaging unit according to claim 2, wherein at least one of said plurality of spring elements and said damping elements has a volume weight of 10 to 120 $kg/m^3$ and a compression hardness at 40% of 2 to 12 kPa.

8. The packaging unit according to claim 7, wherein at least one of said plurality of spring elements and said damping elements has a volume weight of 15 to 80 $kg/m^3$ and a compression hardness at 40% of 3 to 10 kPa.

9. The packaging unit according to claim 2, wherein said transport unit interior part is spaced apart from said transport unit exterior part by additional damping elements at side regions which are formed by said side elements of at least one of said transport unit exterior part and said transport unit interior part.

10. The packaging unit according to claim 9, wherein said additional damping elements are formed from a foam material.

11. The packaging unit according to claim 9, wherein at least one damping element has a surface making contact with said transport unit exterior part that is larger than a surface making contact with said transport unit interior part.

12. The packaging unit according to claim 1, further comprising a winding core supported by said transport unit, wherein said mounting support comprises two saddles, one of the winding core and a holding element connected to the winding core having an extended region on both sides relative to a glass material which can be wound onto the winding core, an outside diameter of one of the winding core and the holding element is configured to be placed on said saddles in its extended region following a contour of at least part of its circumference.

13. The packaging unit according to claim 1, wherein an acceleration factor for a glass roll packed in said packaging unit at a resonance frequency of said packaging unit with the glass roll is less than 8.

14. The packaging unit according to claim 13, wherein the acceleration factor for a glass roll packed in said packaging unit at a resonance frequency of said packaging unit with the glass roll is less than 5.

15. The packaging unit according to claim 13, wherein the acceleration factor for a glass roll packaged in said packaging unit at the resonance frequency of said packaging unit with the glass roll meets a ratio $19.2-6\times(G-100)/65$, wherein G is a weight of the glass roll in a range of 10 to 165 kg.

16. The packaging unit according to claim 1, wherein said mounting support for accommodation of one of the winding core and a holding element connected with the winding core includes a buffer material.

17. The packaging unit according to claim 1, further comprising a winding core supported by said transport unit and a fastening device configured to secure one of the winding core and a holding element which is connected with the winding core to said mounting support.

18. The packaging unit according to claim 1, further comprising a transport rack configured to carry said transport unit, wherein said transport rack is one of a wooden, metal and plastic transport rack.

19. A method of transporting a glass material, comprising the steps of:

providing a transport unit including:

a mounting support for a winding core;

a transport unit interior part including a floor element and a plurality of side elements, said mounting support for the winding core being one of connected always with two side elements of the transport unit interior part which are located opposite each other and formed by two side elements of said transport unit interior part which are located opposite each other; and a transport unit exterior part including a floor element, a plurality of side elements and a cover element, said transport unit exterior part being spaced apart from said transport unit interior part in a floor region by a plurality of spring elements residing between said transport unit interior part and said transport unit exterior part so that said transport unit interior part is arranged vibration-decoupled from said transport unit exterior part; and accommodating a glass material on said transport unit.

20. The method according to claim 19, wherein said glass material is a glass ribbon which is wound on a winding core.

* * * * *